United States Patent [19]

Miller

[11] 4,023,469

[45] May 17, 1977

[54] PISTON AND PISTON ROD CONSTRUCTION FOR PUMPS AND METHOD OF FLUSHING PISTON-TYPE PUMPS

[75] Inventor: John E. Miller, Dallas, Tex.

[73] Assignee: United States Steel Corporation, Pittsburgh, Pa.

[22] Filed: Aug. 9, 1972

[21] Appl. No.: 278,902

[52] U.S. Cl. ..... 92/86.5; 92/87; 92/112; 92/160

[51] Int. Cl.[2] ..... F01B 31/00

[58] Field of Search ..... 92/86.5, 87, 174, 182, 92/112, 160; 417/437

[56] References Cited

UNITED STATES PATENTS

| | | | |
|---|---|---|---|
| 1,818,187 | 8/1931 | Bailey | 92/112 X |
| 2,188,105 | 1/1940 | Caldwell | 92/112 X |
| 2,315,012 | 3/1943 | Park | 92/175 |
| 2,367,185 | 1/1945 | Cary | 92/87 |
| 2,827,860 | 3/1958 | Roberts | 92/160 X |
| 3,104,619 | 9/1963 | Swarthout | 92/87 |
| 3,279,383 | 10/1966 | Smith | 92/87 X |

FOREIGN PATENTS OR APPLICATIONS

| | | | |
|---|---|---|---|
| 638,866 | 2/1928 | France | 92/174 |
| 749,695 | 5/1956 | United Kingdom | 92/28 |

*Primary Examiner*—Irwin C. Cohen
*Attorney, Agent, or Firm*—Walter P. Wood

[57] ABSTRACT

A piston and piston rod construction for use in a double-acting reciprocating pump, and a method of flushing a piston-type pump. The piston has spaced apart rubbers mounted on a body intermediate its length. The rubbers have confronting lips. Each rubber alternately is the working rubber and the idle rubber as the pump operates. Fluid under a pressure greater than the pump discharge pressure is introduced to the space between rubbers, where it is effective to flush particles from the surface of the liner in front of the working rubber.

4 Claims, 1 Drawing Figure

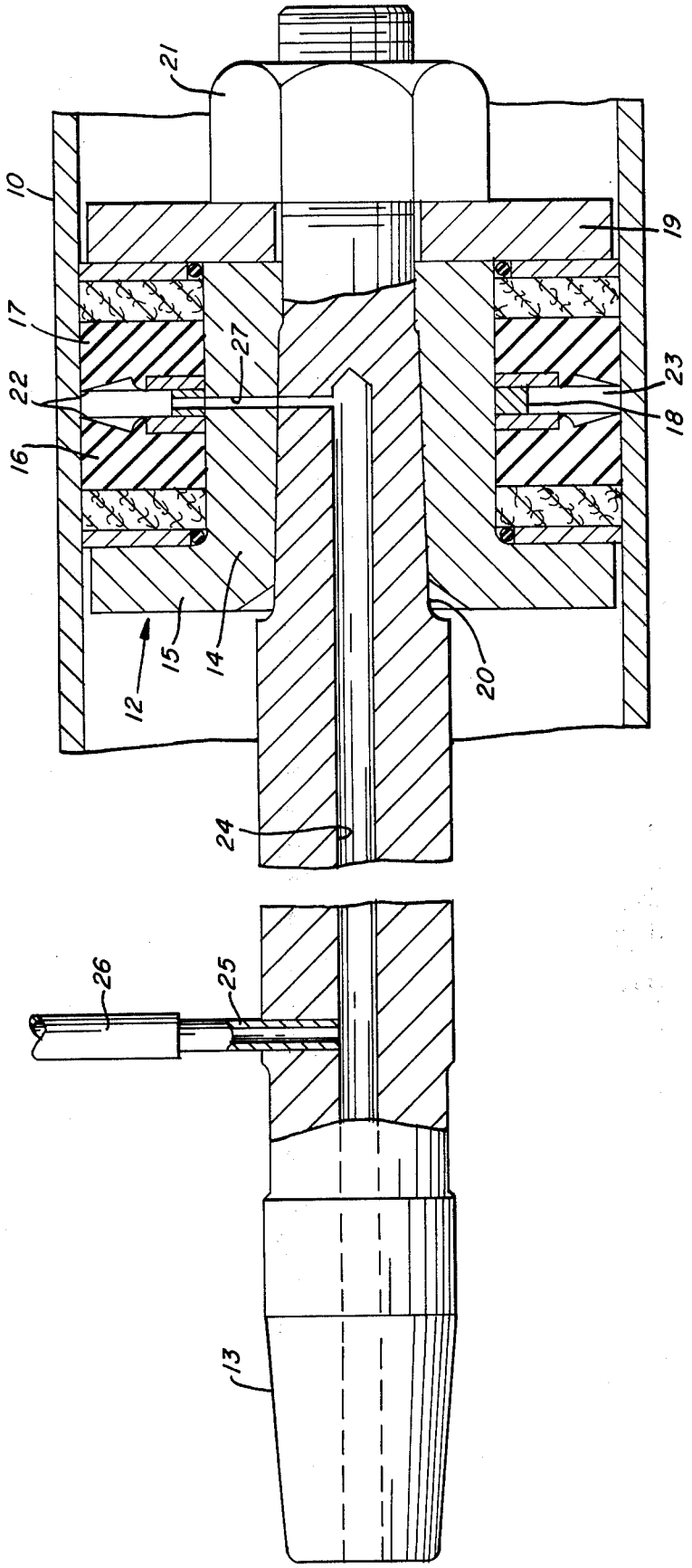
21
10
19
17
27
22
23
18
16
15
14
12
20
24
26
25
13

PISTON AND PISTON ROD CONSTRUCTION FOR PUMPS AND METHOD OF FLUSHING PISTON-TYPE PUMPS

This invention relates to an improved piston and piston rod construction for use in a double-acting reciprocating pump, and to an improved method of flushing a piston-type pump.

Reciprocating pumps used for handling abrasive slurries commonly are either of an outside-packed plunger-type or of a double-acting piston-type. The former have a elastomer or rubber-like outside packing, and the latter elastomer rings or "rubbers" forming part of the piston. Most pistons have rubbers at opposite ends of the piston body. The rubber which faces in the direction of piston travel is the working rubber, the other the idle rubber, and of course they alternate with changes in the direction of piston travel. The life of elastomer parts and associated parts against which they operate can be prolonged if abrasive particles in the slurry are continuously flushed away with a fluid such as clean water. To flush a piston-type pump effectively, it is necessary to wash particles away from the surface of the cylinder liner in front of the working rubber. If an attempt is made to introduce flushing fluid through the piston body between rubbers located at the ends of the body, the fluid goes between the idle rubber ad the cylinder liner, where it merely dilutes the slurry and is ineffective for flushing. Consequently it has been considered practical heretofore to flush only pumps of the plunger-type.

An object of my invention is to provide an improved piston and piston rod construction which enables me to flush particles from the surface of the cylinder liner in front of the working rubber of a double-acting pump of the piston-type.

A more specific object is to provide a piston of a type in which the rubbers confront each other intermediate the piston body with the working rubber always trailing the idle rubber (known per se), but which has means for introducing flushing fluid between rubbers, where it is effective to flush particles from the liner surface in front of the working rubber.

A further object is to provide an improved method of flushing a double-acting piston-type reciprocating pump in which I continuously flush particles from the surface of the cylinder liner in front of the working rubber.

In the drawing:

The single FIGURE is a partly diagrammatic vertical sectional view of a pump equipped with a piston and piston rod constructed in accordance with my invention.

The drawing shows a portion of a double-acting reciprocating pump which includes a cylinder liner 10, a piston 12 within the liner, and a piston rod 13 attached to the piston. The pump can be conventional apart from my piston and piston rod construction, and hence is not shown in detail. The piston itself is generally similar to that shown in Park U.S. Pat. No. 2,315,012. This piston includes a body formed of a integral sleeve 14 and end plate 15, first and second rubbers 16 and 17 and a spacer 18 therebetween mounted on the sleeve, and a follower 19. The piston rod 13 has an end portion 20 of reduced diameter on which the piston body 14, 15 and follower 19 are mounted and held in position by a nut 21. The rubbers have confronting lips 22 with an annular space 23 therebetween.

The piston rod 13 has an axial bore 24. Outside the cylinder the piston rod has a radial inlet 25 to which I connect a flexible hose 26. The hose leads to a source of fluid (not shown) which is under a pressure greater than the discharge pressure of the pump. The piston rod and spacer 18 have one or more radial outlets 27 which lead from the bore 24 into the annular space 23 between rubbers 16 and 17. The end of the piston rod remote from the piston is connected to a suitable reciprocating drive (not shown).

In accordance with my flushing method, I continuously introduce flushing fluid, preferably clean water, to the space 23 between rubbers 16 and 17. Such fluid travels from the pressurized source through the hose 26, inlet 25, bore 24 and outlet 27 to the space 23. When the piston 12 travels toward the right as viewed in the drawing, the first rubber 16 is the working rubber and the second rubber 17 the idle rubber. This relation is reversed when the piston travels toward the left. In each instance the trailing rubber is the working rubber. The flushing fluid always impinges on the liner surface in front of the working rubber, where it effectively flushes away abrasive particles in the material handled by the pump. Thus the working rubber always operates against a cleanly washed surface.

At first impression it might appear that space 23 between the confronting lips 22 of the rubbers 16 and 17 would hydraulically lock and no circulation of the flushing fluid can take place. I have determined through actual experiments that any hydraulic locking is immediately broken, and that the flushing fluid circulates as soon as the piston commences to move. There is a momentary hydraulic lock at the end of each stroke while the piston is at rest for an instant, but this lock serves to provide a purge at the beginning of the next stroke, and produces an even better flushing action.

I claim:

1. In a double-acting reciprocating pump, which includes a cylinder liner, a piston within said liner, and a piston rod attached to said piston;

said piston including a body mounted on said rod, first and second rubbers and a spacer therebetween mounted on said body, and a follower mounted on said rod, said rubbers having confronting lips directed toward each other with an annular space therebetween, said rubbers alternating as the working and idle rubber during operation of the pump with the working rubber trailing the idle rubber; and means connected with said piston rod for continuously introducing flushing fluid under a pressure greater than the discharge pressure of the pump to said annular space where it is effective to wash particles from the surface of said liner in front of the working rubber.

2. A pump as defined in claim 1 in which said means includes an axial bore in said rod, an inlet connected to said rod outside said liner and leading to said bore, and one or more outlets in said rod and said spacer leading from said bore to said annular space.

3. A method of flushing a double-acting piston-type reciprocating pump, the piston of which has a pair of spaced apart rubbers with confronting lips directed toward each other operating against the surface of a cylinder liner, said rubbers alternating as the working rubber and the idle rubber as the piston reciprocates with the working rubber always trailing the idle rubber, said method comprising continuously introducing flushing liquid to the space between rubbers at a pressure greater than the pump discharge pressure, said flushing liquid acting on the surface of the liner in front of the working rubber.

4. A method as defined in claim 3 comprising the further steps of forming a momentary hydraulic lock in the space between rubbers at the end of each piston stroke, and breaking said lock as the piston commences to move to provide a purge.

* * * * *